US009125494B2

(12) United States Patent
Helton

(10) Patent No.: US 9,125,494 B2
(45) Date of Patent: Sep. 8, 2015

(54) READY TO ASSEMBLE MODULAR UPHOLSTERY

(71) Applicant: Roger Allen Helton, Hickory, NC (US)

(72) Inventor: Roger Allen Helton, Hickory, NC (US)

(73) Assignee: Roger Helton, Hickory, NC (US)

( * ) Notice: Subject to any disclaimer, the term of this patent is extended or adjusted under 35 U.S.C. 154(b) by 91 days.

(21) Appl. No.: 14/079,602

(22) Filed: Nov. 13, 2013

(65) Prior Publication Data

US 2014/0130322 A1 May 15, 2014

Related U.S. Application Data

(60) Provisional application No. 61/725,534, filed on Nov. 13, 2012.

(51) Int. Cl.
*A47C 4/02* (2006.01)
*A47C 17/02* (2006.01)

(52) U.S. Cl.
CPC ..... *A47C 4/028* (2013.01); *A47C 17/02* (2013.01); *Y10T 29/481* (2015.01)

(58) Field of Classification Search
CPC ..... F16B 21/09; F16B 12/22; F16B 12/34
USPC ..... 297/440.15, 440.16, 440.23, 440.1
See application file for complete search history.

(56) References Cited

U.S. PATENT DOCUMENTS

| | | | | |
|---|---|---|---|---|
| 4,786,119 | A * | 11/1988 | Smuda | 312/195 |
| 5,611,639 | A * | 3/1997 | Levenberg | 403/397 |
| 5,738,462 | A * | 4/1998 | Petersen et al. | 403/353 |
| 6,595,592 | B1 * | 7/2003 | Wieland et al. | 297/440.23 |
| 2009/0016807 | A1 * | 1/2009 | Koch | 403/26 |
| 2014/0059829 | A1 * | 3/2014 | Weber et al. | 29/428 |

* cited by examiner

*Primary Examiner* — Sarah B McPartlin

(57) ABSTRACT

Modular ready to assembly furniture consists of components when assembled will embody a chair, sofa, loveseat or sofa sectional. These modular components which may include but not limited to arm component and back components. As one component consisting of a bolt with a flat bottom head protruding from the inside part at an angle relative to horizontal. The opposite component having a integrated keyhole slot consisting of a internal machined tapered ramp. The head of the bolt fits through internal keyhole slot. Thus the angle of the internal tapered ramp, corresponds to bottom flat side of the bolt head protruding at a precise angle relative to horizontal and being at the relative matching angle's, thus the back side of the bolt slides up the integrated tapered ramp. This action pulls together the components. When the flat bottom bolt head and the internal tapered ramp are fully seated the components will be held together at a precise and aligned position. The unique feature of this internal connection of the preferred embodiments is that the bolt and keyhole slot after assembly will be completely hidden from view and allowing for any required adjustment for variances in materials and manufacturing. This special adjustable hidden connector allows for quick self tightening engagement and precision alignment of the components, in which the components may be covered in various types of materials.

2 Claims, 3 Drawing Sheets

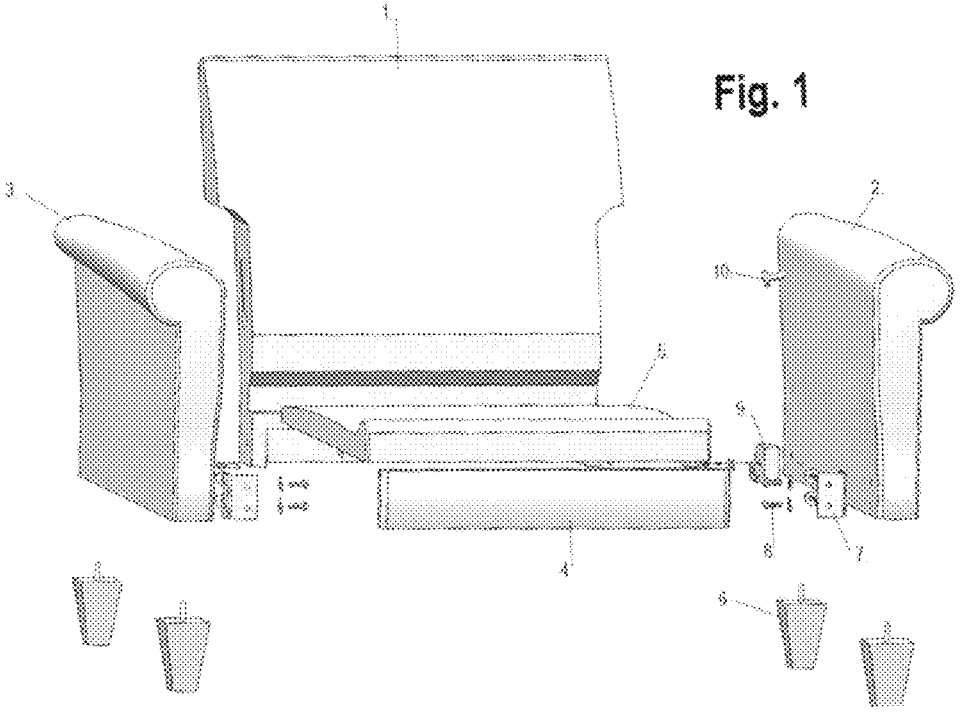
Fig. 1
Fig. 2
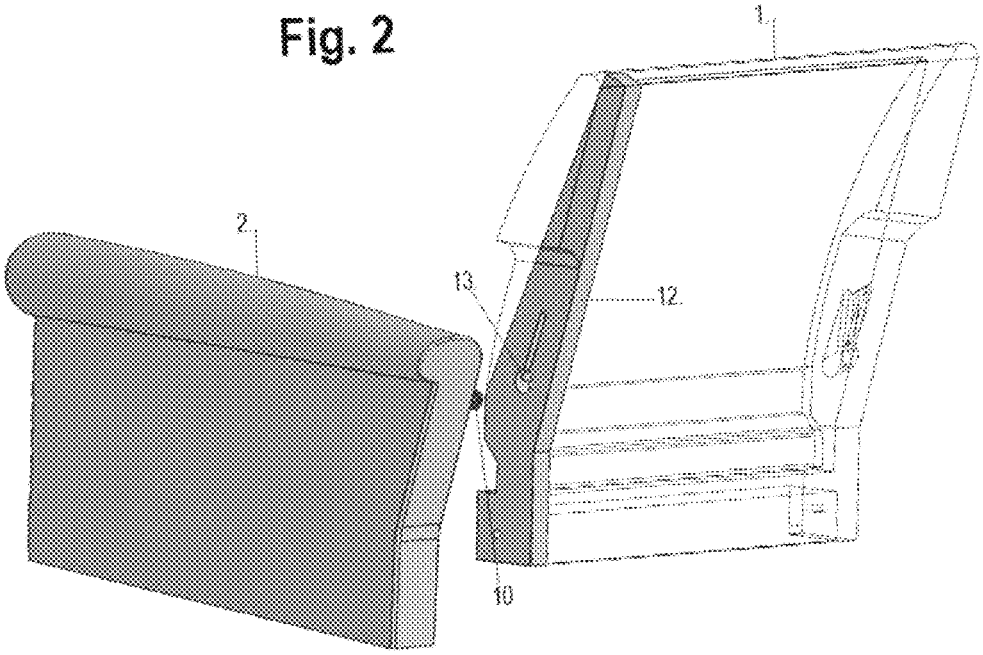

READY TO ASSEMBLE MODULAR UPHOLSTERY

CROSS-REFERENCE TO RELATED APPLICATIONS

In Part of claims benefit of Provisional Application Ser. No. 61/725,534 Filing date: Nov. 13, 2012

FEDERALLY SPONSORED RESEARCH

NA

SEQUENCE LISTING

NA

BACKGROUND OF THE INVENTION

RTA or ready to assemble products are very common items found in the current market place. For manufacturing and shipping large items the advantages and cost savings of RTA is widely accepted. Finished wood or casegoods furniture is no exception. However, currently furniture customers and retailers still face challenges finding and purchasing quality RTA upholstered furniture. The invention of this special connector and the use of more standard type connectors for assembling the different components as described will solve this problem.

Upholstered furniture usually consists of seat, back and arms in various shapes and sizes. A frame consisting of these parts is joined together using staples, wood dowels and/or glue. This frame moves through manufacturing in stages adding supporting material, springs, padding and covered in upholstery materials as a single large unit. Then packaged for shipping. A much more efficient method is to manufacture individual components through an assembly line designed for that component. Each component will be packaged together using much less space, thus saving substance-sully on shipping, handling and warehousing costs. Assembling together the components using this special connections and metal brackets and bolts provide a much stronger frame. This compared to standard manufacturing methods using staples, wood dowels and/or glue. Quality ready to assemble upholstery requires that each component to completely covered or upholstered and finished. After assembly and sitting upright their should be no visual signs of connectors and no gaps or movement between any parts. The style, design and comfort should not be limited to only one or two choices. Previous attempts at ready to assemble upholstery has not been able to address all these issues. Their are three major points of connection or stress areas of where the resting arm attaches to the back in a standard upholstered frame. This embodiment addresses these areas that has been very problematic in ready to assemble components. These areas will be described and shown in greater detail in the drawings and detailed summary of the said embodiment.

BRIEF DESCRIPTION OF THE DRAWINGS

FIG. 1 shows an exploded front perspective view of one embodiment of the chair in accordance with the invention. The seat and backrest cushions have been removed as to provide a clearer view of the said embodiment.

FIG. 2 is a perspective view of the backside of the chair. Thus showing the right side arm component 2 and the back component 1. The back component is shown as a wireframe with the exception of the internal back post 12 show as a solid part.

DESCRIPTION OF THE PREFERRED EMBODIMENT

Figure 3:
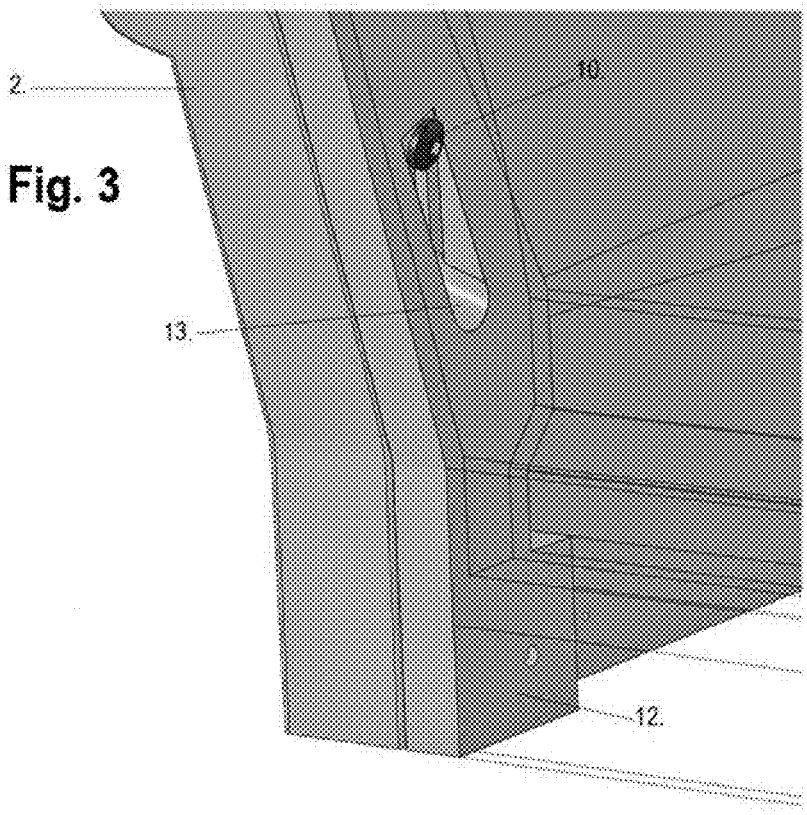
FIG. 3 is an enlarged view from FIG. 2 showing the internal back post 12 within back component 1 assembled to the arm component 2.
Figure 4:
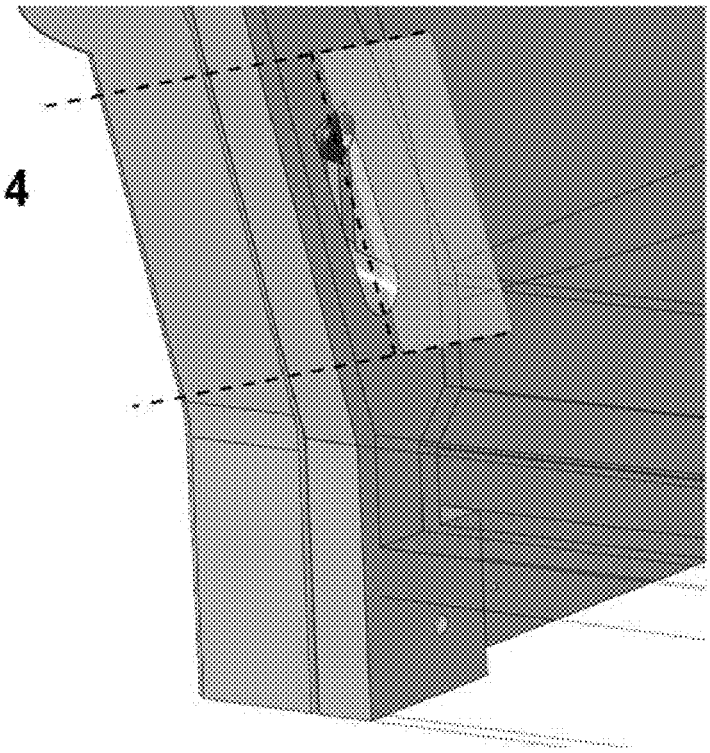
FIG. 4 shows from FIG. 3 the plane in which the cross sectional view is taken in the following FIG. 5.
Figure 5:
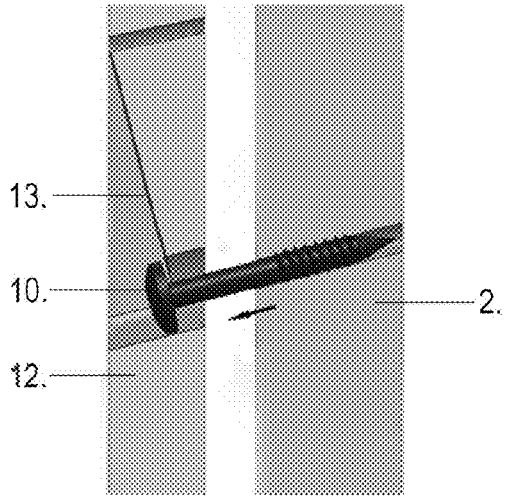
FIG. 5 is a cross sectional view of arm component 2 and the internal back post 12 within back component 1. Thus illustrating the assembly motion of said invention.
Figure 5A:
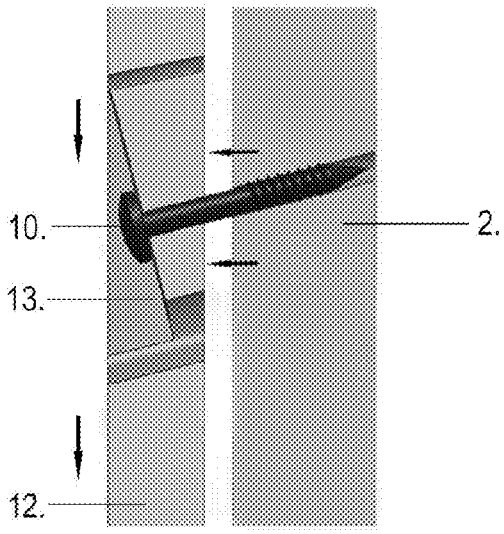
FIG. 5A is a cross sectional view showing the motion of assembly of said invention.
Figure 5B:
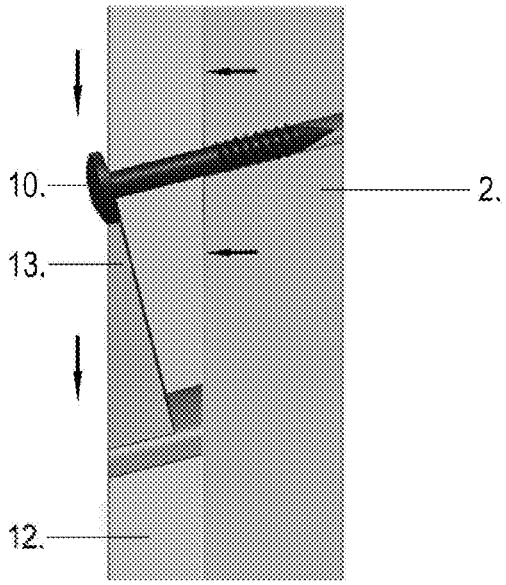
FIG. 5B is a cross sectional view showing the completed motion of assembly of said embodiment.

With reference to FIG. 1, this is an illustrated exploded view of a chair embodying the present invention. While this is one embodiment of said invention, that is should be know that the invention is equally applicable to sofas and or any other item of seating furniture that includes but not limited to a seat, arm rest and back rest. The chair comprises of components, back 1, right arm 2, left arm 3, seat rail 4, seat deck 5, legs 6, metal parts 7-8, guide block 9, and connecting bolt 10, mounted into components arm 2-3. The components 1-6 can be built from wood or engineered wood, plastics and any other materials of sufficient strength. These components can also be covered in any suitable materials of fabrics, leathers or natural fibers. Referring now to FIG. 2 showing components back 1 and right arm 2. The component back 1 is shown in a perspective wire frame illustrating the internal part back post 12. With back post 12 is shown as a solid part to better illustrate the assembly process of the said invention. In the process of assembly the component arm 2, with connecting bolt 10 is inserted into the keyhole 13 of the component back 2. The keyhole is one aspect of named 13 keyhole slot, this keyhole which also includes an internal tapered ramp of which all is mechanically machined into the part back post 12. This insertion of connecting bolt 10 into the machined slot 13, in which the head of the said bolt sliding up the machined ramp and results will be fully described hereafter. Referring now to FIG. 3 showing the final result of the connecting bolt 10 into the machined slot 13 of which is an integral part of the back post 12. The results as shown in FIG. 3 is a mechanical engagement of component arm 2 with component back 1. To better illustrate this mechanical motion of engagement, a cut-away sectional view of the machined slot 13 is required. The illustrated plane of the cut-away sectional view is shown if FIG. 4. Referring now to FIG. 5 illustrating the sectioned plane of component arm 2 and part back post 12. This illustrated plane cuts vertically through the center length of machined slot 13, as shown previously in FIG. 4. The part connecting bolt 10 of which is screwed into component arm 2 in a predetermined spot at the correct angle that is precisely of the same angle and degree cut of the machined ramp 13 in part back post 12. This precision fit allows the bottom surface of the screw head of part connecting bolt 10 to slide along the ramped path of the machined slot 13. Inserting the part connecting bolt 10 into the keyhole of the machined slot 13, as shown by the arrow in FIG. 5, begins with sufficient space between component arm 2 and component back 1. As shown if FIG. 5A, the downward motion push of the part back post 12, as shown by the vertical arrows, allows the part connecting bolt 10 to slide along the machined ramp 13. The sliding of the part connecting bolt 10 along the machined path 13, will bring together the component arm 2 and the component back 1, as shown by the horizontal arrows in FIG. 5A and FIG. 5B. As shown if FIG. 5B, at the point in which connecting bolt 10 slides along the path of the machined ramp 13, reaches the end if the slot, the component arm 2 and component back 1 will essentially bring together with no space between the 2 said components.

Thus the chair back and arm is securely attached together at a height above the bottom connecting point in a typical arm to back connection. Once the connection of the arm is made at this bottom arm to back connection and also to the front seat portion by means illustrated in FIG. 1, thus providing a very strong 3 point rectangle path of connection points, with no visible signs of the connections or connectors.

The invention claimed is:

1. A ready to assemble modular furniture item comprising:

a first modular component;

a second modular component; and a means for fastening the first modular component and the second modular component securely together, wherein the means for fastening comprises:

a bolt projecting a preselected distance from a lateral side of said first modular component at an angle with respect to horizontal, the bolt having a head with a substantially planar underside and a shaft;

a keyhole slot formed on an outer surface of said second modular component, said keyhole slot including an expanded portion capable of receiving the bolt head and a narrow portion sized to enable the shaft portion to slide therein;

a machined ramp formed on an inner surface of said second modular component, wherein said machined ramp is angled with respect to said outer surface of said second modular component and is substantially parallel with the substantially planar underside of said bolt, the machined ramp has a minimum thickness measured from said outer surface of said second modular component at a position corresponding to said expanded portion of said key hole slot and a maximum thickness measured from said outer surface of said second modular component at a position corresponding to an end of the narrow portion of said keyhole slot distal from said expanded portion;

wherein said bolt head is capable of being inserted into said expanded portion of said keyhole slot and said substantially planar underside of said bolt head is slid along said machined ramp, such that the bolt head is drawn further towards said inner surface of said second modular component thereby pulling the first and second modular components tightly together.

2. The ready to assembly modular furniture item of claim 1, wherein the preselected distance is adjustable by rotating said bolt clockwise or counterclockwise with respect to said first modular component to accommodate different thicknesses of covering materials provided on the first and second modular components.

* * * * *